US007047573B2

(12) United States Patent
Young

(10) Patent No.: US 7,047,573 B2
(45) Date of Patent: May 23, 2006

(54) SUPER COLLAPSIBLE AND COMPACTABLE PORTABLE POTTY TRAINER

(76) Inventor: John Francis Young, N70 W39060 Foster Dr., Oconomowoc, WI (US) 53066

( * ) Notice: Subject to any disclaimer, the term of this patent is extended or adjusted under 35 U.S.C. 154(b) by 0 days.

(21) Appl. No.: 10/860,239

(22) Filed: Jun. 3, 2004

(65) Prior Publication Data

US 2005/0268388 A1 Dec. 8, 2005

(51) Int. Cl.
*A47K 13/00* (2006.01)

(52) U.S. Cl. ..... 4/239; 4/245.1

(58) Field of Classification Search ..... 4/245.1–245.3, 4/245.5, 239, 902

See application file for complete search history.

(56) References Cited

U.S. PATENT DOCUMENTS 1,358,222 A * 11/1920 Levy ..... 4/245.3
1,710,620 A * 4/1929 Hawkins ..... 4/245.5
2,249,322 A * 7/1941 McQuaid ..... 4/239
2,888,686 A * 6/1959 Schrader ..... 4/239

* cited by examiner

*Primary Examiner*—Charles E. Phillips
(74) *Attorney, Agent, or Firm*—von Briesen & Roper, S.c.; Galo I. Vargas

(57) ABSTRACT

A collapsible, portable, light weight, reusable, machine washable potty training device that may carried inconspicuously into any private or public restroom and that may be consistently fitted onto a conventional toilet seat effortlessly, with the use of minimum stall space, to teach children to use toilets.

4 Claims, 3 Drawing Sheets

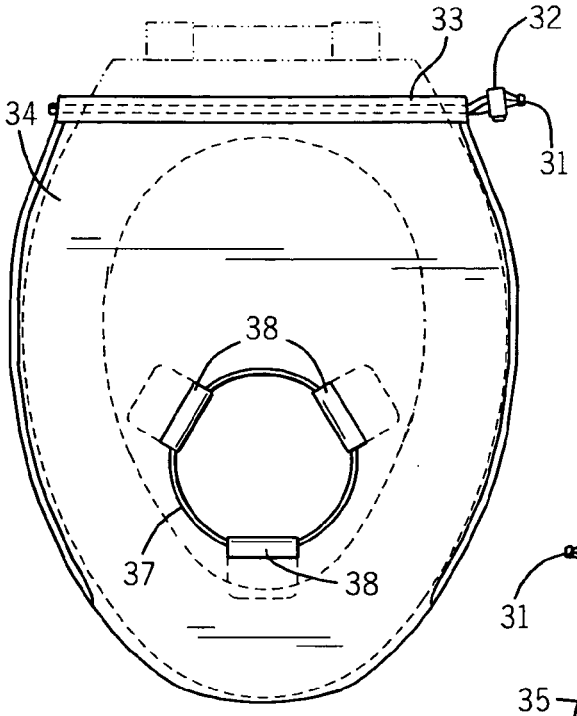
FIG. 4
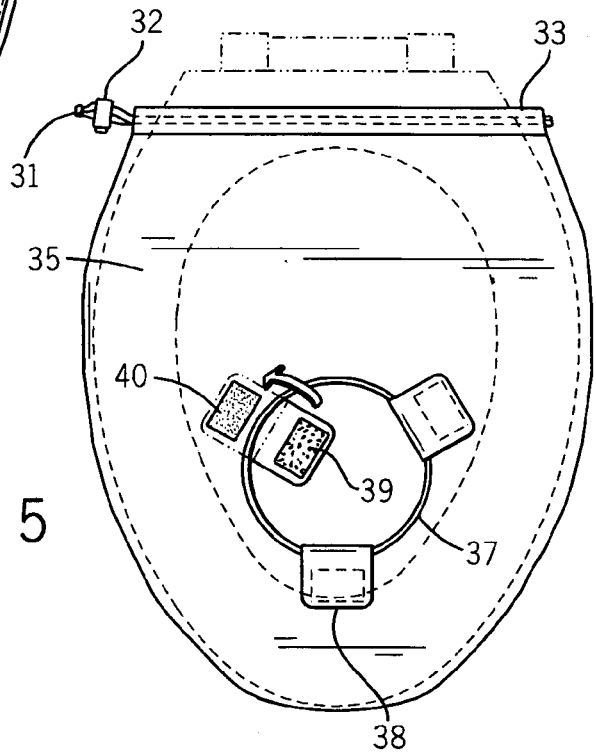
FIG. 5
FIG. 6
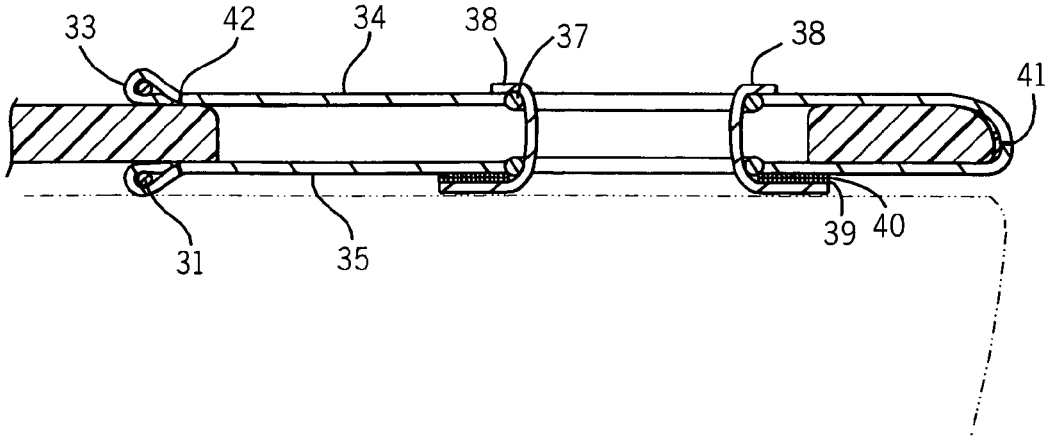

SUPER COLLAPSIBLE AND COMPACTABLE PORTABLE POTTY TRAINER

FIELD OF THE INVENTION

The present invention relates to the field of devices used to teach and assist children to use toilets. Specifically, the invention relates to a re-usable device that may be easily and inconspicuously transported and fitted onto a toilet seat to permit a child to use a toilet while preventing the child from coming into contact with the toilet seat or fluids located within the toilet bowl.

BACKGROUND OF THE INVENTION

The use of potty-chairs as potty training devices is well known among parents. When choosing a potty training device, parents are typically concerned with hygiene, transportability and adaptability. This is the case particularly with parents that travel often or enjoy outdoor activities such as visiting public parks or camping with their children.

Hygiene is a concern when using toilets in public places such as parks or campgrounds because these places are usually equipped with a limited number of toilets, the toilets are not cleaned regularly, and because hundreds of people may use the same toilet within a single day.

Transportability and adaptability are a concern because parents must be able to simultaneously transport their children and the potty training devices. In addition, parents must be able to quickly reassemble the potty training devices within standard size stalls. To a parent a smaller lighter device is preferable, one that may be transported inconspicuously into all public places. Not just public parks or campgrounds but also supermarkets, restaurants, doctor offices, hair salons, or other similar places. Also, a parent would prefer a device that was highly reusable, easy to clean and disinfect, and simple to use. Preferably a device that could be cleaned and disinfected through the use of a powerful detergent and the high water temperatures of a washing machine. Simplicity of use is important because it ensures that the device can be used in the same manner every time thereby making the use of toilets second nature.

To address these needs, various potty training devices have been designed and are known in the prior art. For instance, U.S. Pat. No. 4,777,672 (patent '672) discloses a Children's Convertible Toilet Apparatus. Patent '672 discloses an apparatus that is both a freestanding toilet and a potty trainer that may be utilized with a conventional toilet. The apparatus is generally manufactured from molded plastic and is provided with handles. The apparatus may be folded for storage and transportation. However, even in its folded position, the apparatus may not be transported in a standard size baby bag or knap-sack, and the apparatus may be difficult to re-assemble in a standard size stall or outhouse. The apparatus may only be cleaned manually.

U.S. Pat. No. 5,991,938 (patent '938) discloses a Potty Trainer and Desk Combination. Patent '938 discloses a device that serves both a child-size toilet and as a working desk. Although patent '938 does not specify the material of construction, the device appears to be generally manufactured from a light but rigid or sturdy material, and device is provided with a handle that may be used for transportation. However, even when folded the device may not be transported in a standard size baby bag or knap-sack, and may be difficult to re-assemble in a standard size stall or outhouse. The device may only be cleaned manually.

U.S. Pat. No. 6,473,911 (patent '911) discloses a Disposable, Compact, Portable Toddler-Size Toilet Seat Protector. Patent '911 discloses a child-size toilet seat protector that may be utilized in conjunction with conventional toilets. The toilet seat protector appears to be manufactured of cardboard or other similar material. Although the toilet seat protector is more transportable than patent '672 and patent '938, it may not be folded and transported in containers that are significantly smaller than a standard size baby bag or knap-sack. The toilet seat protector is not reusable.

U.S. Pat. No. 6,647,560 (patent '560) discloses a Collapsible Portable Potty trainer. Patent '560 discloses a potty trainer that may be collapsed to a size small enough to be transported in a baby bag or knap sack. The potty trainer includes four foldable legs, a seat, and a cover. The legs are to be manufactured from a light and sturdy material such as aluminum. The seat is flexible and the cover includes a waste receptacle. Like patent '911, patent '560 is also more transportable than patent '672 and patent '938. However, also like patent '911, patent '560 may not be compacted and transported in containers that are significantly smaller than a standard size baby bag or knap-sack.

While the above inventions address some of the needs previously discussed, the inventions have serious shortcomings. For instance, transportation is not inconspicuous. It requires standard size baby bags or knap-sacks, or other similar containers (patent '672, patent '938, patent '911, and patent '560). Use is restricted to stalls or outhouses of sufficient size to permit re-assembly (patent '672, patent '938, and patent '560). Cleaning is restricted to normal water temperature and manual labor (patent '672, patent '938, and patent '560 (two of its three components)). Not fully reusable (patent '911 and patent '560 (one of its components)). Thus, there is a need for a potty training device that is compactable enough to be carried inconspicuously, reassembled without the need of an oversized stall (such as the ones designated for the use of disable people), extremely light in weight, highly reusable and machine washable.

SUMMARY OF THE INVENTION

The present invention resolves the shortcomings and fulfills the needs identified above. The invention relates to a highly collapsible, highly portable, extremely lightweight, highly reusable, machine washable potty training device that may be fitted onto a conventional toilet seat effortlessly, without need of additional stall space, to allow children to use toilets safely. To fulfill these needs, the invention is provided with a compactable, lightweight, washable, and impermeable enclosure that is to be fitted around a toilet seat; resilient bands positioned along the edges of and forming the enclosure; multiple orifices on the enclosure aligned over the toilet bowl; multiple straps connecting the top and bottom portions of the enclosure through the orifices; a sleeve fixed at the open end of the enclosure for receiving a chord; and a stopper placed on and to be used in conjunction with the chord to fasten the open end of the enclosure to a toilet.

There has thus been outlined, rather broadly, the more important features of the present invention so that its detail description, following below, and contributions to the art may be better understood. To this effect, those of ordinary skill in the art should readily recognize the features and advantages of the present invention upon a reading of the detailed description, in conjunction with the accompanying drawings, of the currently preferred and illustrative embodiments of the invention. Thus, before discussing the preferred embodiment of the invention in detailed, it should be understood that the invention should not be limited in its application to the details of the specific components, manufacturing, and arrangement illustrated in the description and drawings below. The invention may be represented in other embodiments and may be practiced in other similar or equivalent manner. Also, it should be understood that the phraseology and terminology utilized herein is not intended and should not be interpreted as being limiting of the present invention.

It is therefore an object of the present invention to provide a potty training device that is highly collapsible and compactable, portable and capable of being inconspicuously transported.

It is another object of the present invention to provide a potty training device that is extremely light so that it can be carried without additional effort.

It is another object of the present invention to provide a potty training device that may be fitted unto any conventional toilet seat.

It is another object of the present invention to provide a potty training device that may be reassembled within the confinements of stalls of any size.

It is another object of the present invention to provide a potty training device that is extremely easy to use.

It is another object of the present invention to provide a potty training device that may be used as a sanitary barrier.

It is another object of the present invention to provide a potty training device that is highly reusable and durable.

It is another object of the present invention to provide a potty training device that is machine washable in its entirety.

It is another object of the present invention to provide a potty training device that may be used with such consistency as to make the use of toilets a natural and normal daily activity.

It is another object of the present invention to provide a potty training device that may be easily manufactured and marketed.

The above together with other objects of the invention, along with various features of novelty that characterize the invention, are identified and explained with more particularity in the claims annexed to and forming part of this disclosure. For a better understanding of the invention, its operating advantages and specific objects attained by its uses, reference should be made to the accompanying drawings and descriptive matter in which there are illustrated preferred embodiments of the invention.

BRIEF DESCRIPTION OF THE DRAWINGS

FIG. 4 is a top view of a preferred embodiment of the invention shown on a toilet seat.

FIG. 5 is a bottom view of a preferred embodiment of the invention shown on a toilet seat.

FIG. 6 is a cross section view of a preferred embodiment of the invention shown on a toilet seat.

DETAILED DESCRIPTION OF THE PREFERRED EMBODIMENTS

Figure 3:
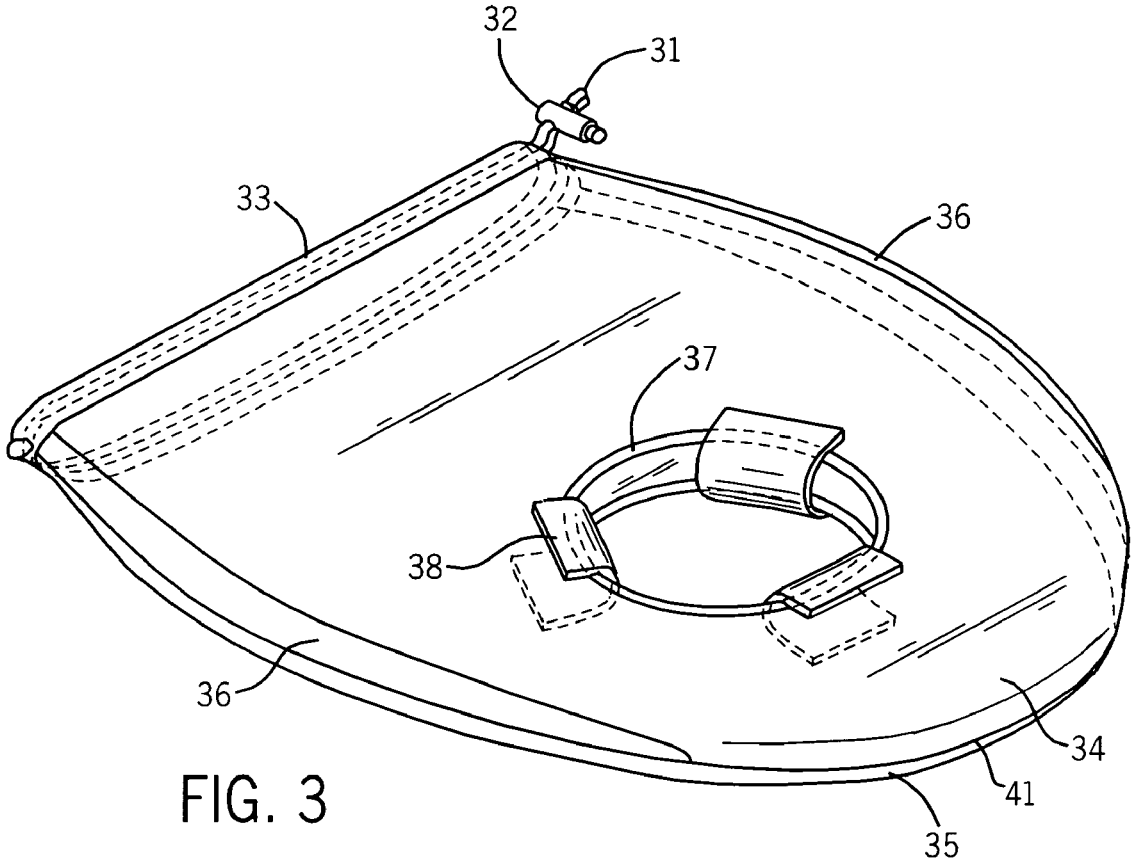
FIG. 3 is a perspective view of a preferred embodiment of the invention.

Referring to the drawings, and particularly to FIG. 1 and FIGS. 3 to 5, in which like reference numbers indicate similar parts in the various views, a preferred embodiment of the invention is shown in FIG. 3.

Figure 1:
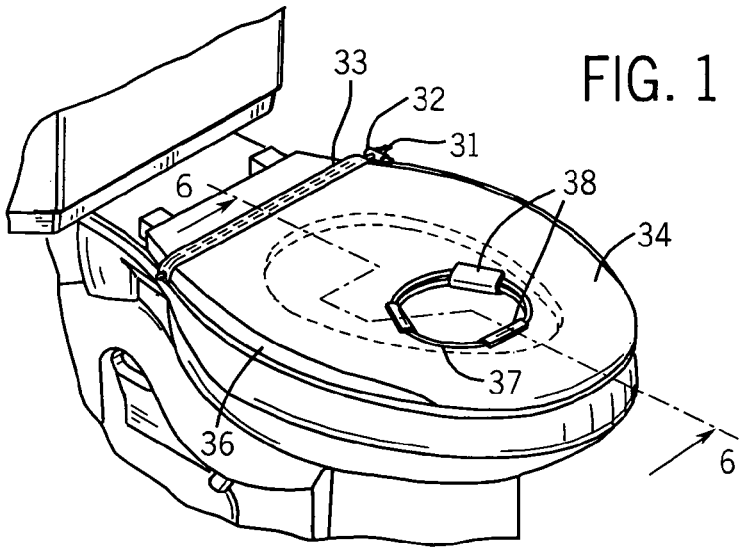
FIG. 1 is a perspective view of a preferred embodiment of the invention shown on a toilet.
Figure 2:
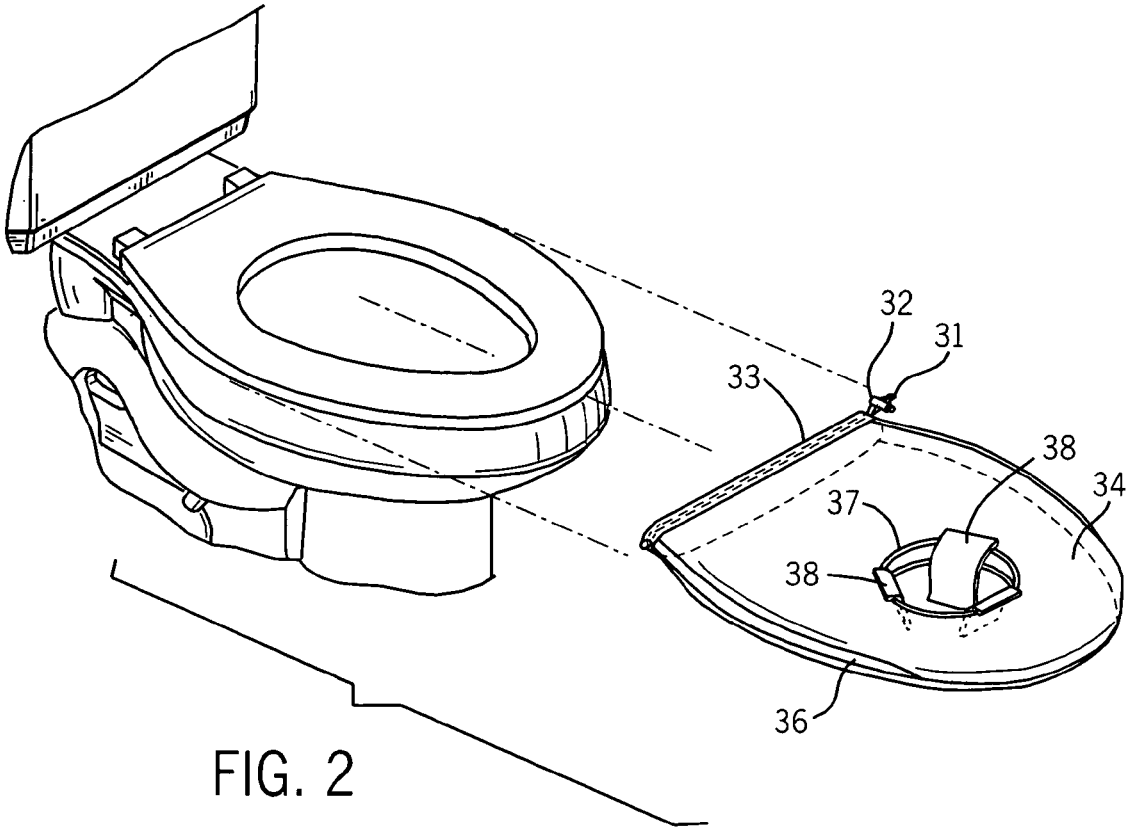
FIG. 2 is a perspective view of a preferred embodiment of the invention shown in an exploded view away from a toilet.

As shown FIG. 3 to FIG. 5, the potty training device is made by a top layer (34), a bottom layer (35), a pair of bands (36), multiple first straps (38), multiple first fastening means (39) and (40), a chord (31), a second fastening means (32), a sleeve (33), a pair of second straps (37), a closed end (41). As shown in FIG. 1, when all of these components are properly assembled and fastened, the potty training device is an enclosure that may be fitted unto and around a toilet seat to provide sufficient support and stability for a child to learn to use a toilet while maintaining a sanitary barrier between the child and the toilet seat.

As shown in FIGS. 4 and 5, the top layer (34) and the bottom layer (35) are generally of oval shape and are to be aligned over each other. The top and bottom layers each have an orifice and the orifices are aligned over each other. The orifices are positioned towards the closed end (41) of the potty training device. The orifices are to be of sufficient size to permit a child to use the toilet comfortably without falling through the orifices. A second strap (37) is fixed along the edge of each orifice. The top and bottom layers are made of flexible, lightweight, washable, easy-to-clean, impermeable, durable, and resilient material.

As shown in FIG. 3, the top layer (34) and the bottom layer (35) are fastened together at the closed end (41) and to the bands (36). The top and bottom layers are not fastened and form an open end at the end where a sleeve (33) is located. Each band (36) is made of flexible, lightweight, washable, easy-to-clean, impermeable, durable, and resilient material. The bands are dimensioned in a manner that allows them to stretch when the enclosure is fitted unto a toilet seat while maintaining the top and bottom layers under tension. The top layer and the bottom layers may be fixed to the closed end (41) and to the side bands (36) by sewing, Velcro, snaps, buttons, or a zipper. The sleeve (33) is fixed to the open end of the enclosure in a manner that permits the placement of chord (31) within the sleeve with the chord ends protruding from the enclosure. Chord (31) is to be used in conjunction with the second fastening means (32) to secure the open end of the potty training device to a toilet seat. The second fastening means may be a spring-loaded stopper or a resilient clamp. In a preferred embodiment the second fastening means is a spring-loaded stopper.

As shown in FIGS. 4 and 5, each first strap (38) is to be fixed at one end to the top layer (34) and at the other end to the bottom layer (35). Each first strap is to be fixed to the top and bottom layers through the orifices of the enclosure by use of a first fastening means located at the end of the straps (39) and on the top and bottom layers (40). The first fastening means may be Velcro, snaps, buttons, zippers or adhesive material. In a preferred embodiment the first fastening means is Velcro. The first straps may be symmetrically positioned along the perimeter of the orifices. One of the purposes of the first straps is to minimize the amount of fluids or other materials that may be deposited between the top and bottom layers when the potty training device is being used. In another preferred embodiment, one end of each first strap may be sewn to the top layer and the other end of each first strap may be fixed to the bottom layer by using the first fastening means described previously.

What is claimed is:

1. A potty training device comprising: an enclosure of generally oval shape having an open end and a closed end, adapted to fit around a toilet seat, having two orifices aligned over each other and concentric to the toilet seat; a multiplicity of first fastening means positioned around the perimeter of the orifices; a multiplicity of first straps having a first fastening means positioned at each end portion of each first strap for connecting each first strap through the orifices to the first fastening means positioned around the perimeter of the orifices; a sleeve connected to the open end and adapted to receive a chord; the chord being positioned within the sleeve and having its end portions protruding from the enclosure; and a second fastening means positioned on at least one of the end portions of the chord for securing the enclosure to a toilet.

2. The potty training device of claim 1, wherein the orifices are small enough to permit a child to seat over them without falling through.

3. The potty training device of claim 2, wherein the enclosure is formed by a top layer, a bottom layer, and at least one resilient band connecting each other at their outer edge portions except for the open end.

4. The potty training device of claim 3, wherein the top layer and bottom layer are made of lightweight, easy-to-wash, and quick-drying material.

* * * * *